United States Patent [19]

de Koning et al.

[11] 4,175,342

[45] Nov. 27, 1979

[54] SUCTION DREDGER

[75] Inventors: Jan de Koning, Amsterdam; Gerrit H. van Zeggelaar, Utrecht, both of Netherlands

[73] Assignee: Goyo Ballast Company Ltd., Tokyo, Japan

[21] Appl. No.: 660,044

[22] Filed: Feb. 23, 1976

Related U.S. Application Data

[63] Continuation-in-part of Ser. No. 517,028, Oct. 22, 1974, abandoned, which is a continuation of Ser. No. 327,402, Jan. 29, 1973, abandoned.

[30] Foreign Application Priority Data

Jan. 28, 1972 [NL] Netherlands ..... 7201218

[51] Int. Cl.[2] ..... E02F 3/88

[52] U.S. Cl. ..... 37/58; 37/72; 91/24; 91/390; 254/172

[58] Field of Search ..... 37/72, 58; 254/172, 254/173, 189; 91/24, 390, 360, 441; 175/5, 7; 166/0.5

[56] References Cited

U.S. PATENT DOCUMENTS

| | | | |
|---|---|---|---|
| 3,208,728 | 9/1965 | Parks | 254/172 |
| 3,309,065 | 3/1967 | Prud'homme et al. | 254/189 X |
| 3,388,070 | 6/1968 | Born et al. | 254/172 |
| 3,512,281 | 5/1970 | Hadjidakis | 37/58 |
| 3,574,999 | 4/1971 | Nectoux | 254/189 X |
| 3,653,635 | 4/1972 | Bates, Jr. et al. | 254/172 |
| 3,681,862 | 8/1972 | De Koning et al. | 37/58 |
| 3,718,316 | 2/1973 | Larralde et al. | 254/172 |
| 3,734,564 | 5/1973 | McKay et al. | 37/69 |
| 3,739,503 | 6/1973 | Barker et al. | 37/72 X |

FOREIGN PATENT DOCUMENTS

| | | | |
|---|---|---|---|
| 799952 | 4/1936 | France | 254/172 |
| 851333 | 10/1960 | United Kingdom | 37/72 |

*Primary Examiner*—Clifford D. Crowder
*Attorney, Agent, or Firm*—Snyder, Brown & Ramik

[57] ABSTRACT

A suction dredger, comprising a vessel and a suspension conveying conduit provided with a pump and having a nozzle suspended by means of at least one cable of a lifting device on the vessel, is improved for preventing breaking of the cable or damage of other dredger parts. To this aim the lifting device comprises a cable length variator having a piston movable in a cylinder, a pick-up system for picking up the travel of the piston, a fluid conduit communicating with the cylinder for supplying and discharging fluid and control circuitry for controlling the supply and discharge of the fluid so in dependence on the travel picked up by the pick-up system, that the piston is pushed backwards into a prescribed stretch.

7 Claims, 9 Drawing Figures

SUCTION DREDGER

CROSS REFERENCE TO RELATED APPLICATION

This application is a continuation-in-part of Ser. No. 517,028 filed Oct. 22, 1974 and now abandoned which, in turn, is a continuation of Ser. No. 327,402, filed Jan. 29, 1973, now abandoned and claiming priority of Jan. 28, 1972.

BACKGROUND

The invention relates to a suction dredger, comprising a vessel and a suspension conveying conduit provided with a pump and having a nozzle suspended by means of at least one cable of a lifting device on the vessel, said lifting device mainly consisting of a winch drum provided with control means for hauling and veering cable in order to adjust the depth of the nozzle with respect to the vessel, and consisting of a cable length variator comprising at least one piston which is movable in a cylinder against the pressure of a fluid and winch has a travel corresponding with the variations of the cable length as a result of sea level movement. Such a suction dredge is known.

This known suction dredger is with a large sea level movement not suitable for sucking up sand from the ground with a nozzle which is deeply inserted into the ground, because in case the nozzle sticks in the ground, with an upward movement of the vessel the ground exerts a downward ground reaction upon the nozzle, owing to which the cable may break or another part of the suction dredger may be damaged.

BRIEF SUMMARY OF THE INVENTION

The invention provides a suction dredger improved in this respect which is characterised by sensing means for picking up the travel of the piston, by a fluid conduit communicating with the cylinder for supplying and discharging fluid and by control means for controlling the supply and discharge of the fluid so in dependence on the travel picked up by the sensing means, that the piston is pushed backwards into a prescribed stroke. As a result of the invention the cable tension is adapted to the variations of the work conditions by a compensating variation of the force exerted by the cylinder on the cable.

BRIEF DESCRIPTION OF THE DRAWING FIGURES

DETAILED DESCRIPTION OF THE INVENTION

Figure 1:
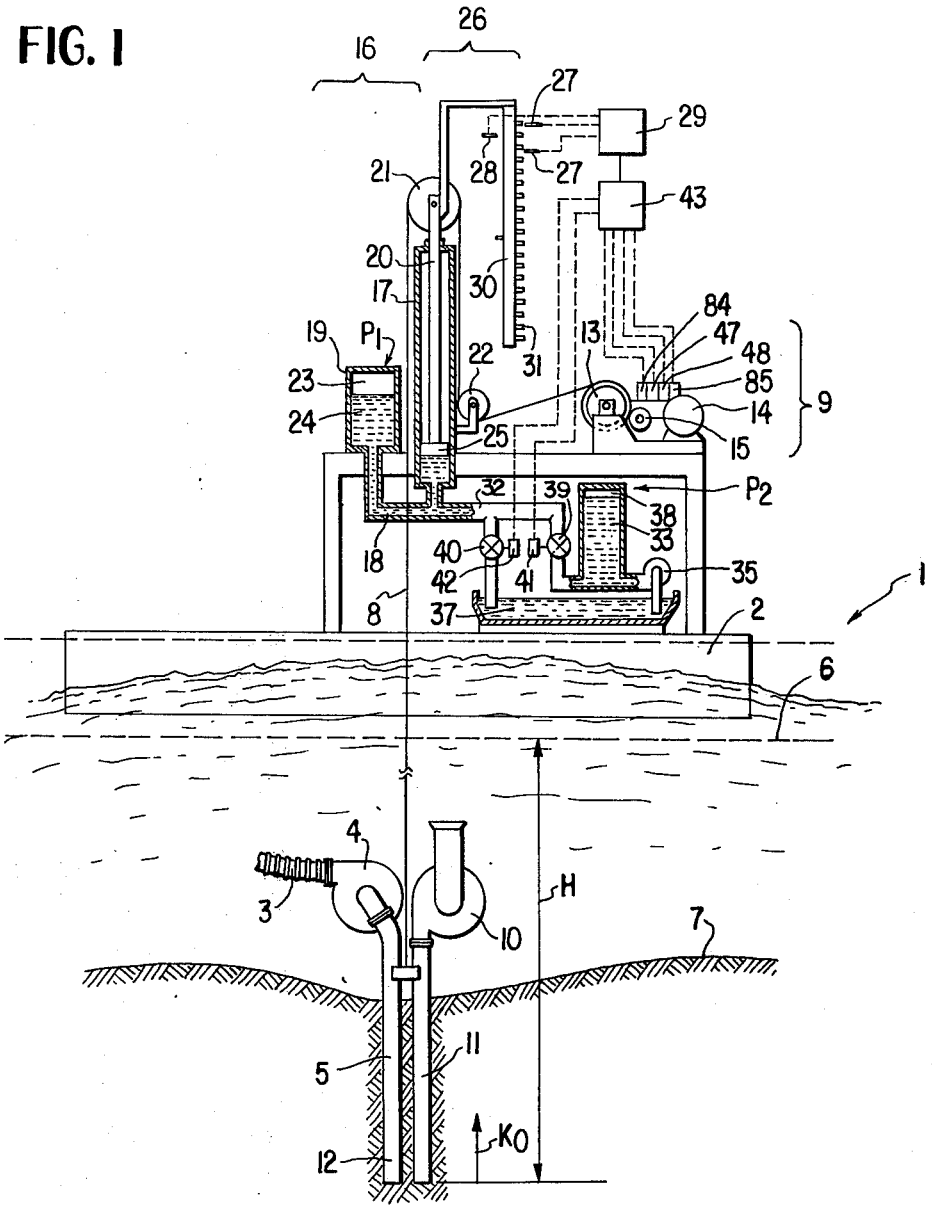
FIG. 1 is a schematic view illustrating a suction dredger according to this invention.

The suction dredger 1 of FIG. 1 comprises a vessel 2 floating on water 6 and a flexible conduit 3 conveying a suspension of sand and water to a place of destination, a pump 4 being mounted in said conduit 3 and a nozzle 5 of said conduit 3 being suspended on the vessel 2 by means of a cable 8 of a lifting device 9 carried by the vessel 2, said nozzle 5 being deeply inserted into the sand 7 to be sucked up and lying under water 6. Water 6 is supplied by means of a water pump 10 carried by the nozzle 5 via a conduit 11 into the sand 7 near the inlet 12 of the nozzle 5, resulting in a suspension of sand 7 and water 6 entering the conduit 3 through the inlet 12 of the nozzle 5. The lifting device 9 mainly consists of a winch drum 13 provided with control means constituted by a motor 14 and a drive gear 15, being controlled for hauling and veering cable 8, in order to adjust the depth H of the nozzle 5 with respect to the vessel 2, and of a cable length variator comprising a hydro-pneumatic cable tension guard 16 which is built up of a hydraulic cylinder 17 communicating via a conduit 18 with a pressure tank 19, wherein air 23 having a low pressure $P_1$ is locked up above liquid 24. The piston rod 20 of the hydraulic cylinder 17 carries a pulley 21 for guiding the cable 8 which is diverted by pulley 22. With an upward ground reaction $K_o$ upon the nozzle 5 during a downward movement of the vessel 2 as a result of sea level movement the distance between the vessel 2 and the nozzle 5 becomes temporarily less than the adjusted depth H and the cable tension guard 16 hauls cable 8 owing to a decrease of the adjusted minimum cable tension, in that the piston rod 20 with the pully 21 moves upwardly then. In the next upward movement of the vessel 2 the cable tension increases, resulting in hauling cable delivered owing to a downward movement of the piston rod 20. The piston 25 of the cylinder 17 moves against the pressure of the liquid 24 with a travel which corresponds with the variations of the cable length as a result of sea level movement.

According to the invention the cylinder 17 communicates with a fluid conduit 32 for supplying and discharging fluid. The suction dredger 1 comprises further control means connected to the fluid conduit 32 for controlling the supply and discharge of fluid so in dependence on the travel picked up by the sensing means 26 that the piston 25 is pushed backwards into a prescribed stroke T. These control means comprise a pressure tank 33, wherein air 38 is locked up and which is kept on a high pressure $P_2$ by a pump 35 with fluid from a tank 37 and which communicates via a control valve 39 with the fluid conduit 32 for supplying liquid. The control means further comprise a control valve 40 for discharging liquid from the fluid conduit 32 to the tank 37.

The control means also comprise sensing means 26 for picking up the travel of the piston 25. These sensing means 26 consist of inductive pick-up members or transducers 27 which are fixedly positioned and which are connected to a two-sense counter 29 as is known per se from pages 12–15 of the book "Praktische schakelingen met direkt afleebare tellers" (practical circuits with counters which can be read immediately) from the 50 series, part II of March 1969, published by N. V. Phillips of Eindhoven. The fixed transducers 27 cooperate with an indication ruler 30 attached to the piston 25, on which ruler 30 marks 31 are provided divided over its length said marks 31 causing magnetic field fluctations when passing the transducers 27 so that the travel R of the piston 25 is signalled stepwise from its middle position. Moreover an inductive sensing member 28 is fixedly positioned in order to make change the sense of the input signal A of the digital two-sense counter 29, each time when the piston 25 passes its mid position. The two-sense counter 29 actuates the calculating device 43, which will be described further with reference to FIGS. 2 and 3.

Two limiting value switches 56 and 57 are connected to the counter 29, with which switches 56 and 57 travels of the piston 25 above and below the adjusted limiting values +U and −U respectively are detected. The periods of time $t_B$ and $t_C$ respectively of the exceedings are converted in the impulse forming devices 58 and 59 into impulses of equal height, after which equal voltage arise in the integrators 60 and 61, which are proportional to the periods of $t_B$ and $t_C$ respectively of the exceedings of the adjusted limiting values of +U and −U respectively. After exceeding a limiting value +U or −U also the pulse generator 62 is started. After an adjusted period of time $t_1$ is finished the impulse forming device 63 actuated by signal H commands free the store 65 with signal I and commands then the impulse forming device 66. The store 65 takes over the output voltage F of the subtractor 64. This output voltage F is equal to the voltage difference D−E of the two voltages D and E coming from the integrators 60 and 61. After taking over this voltage difference D−E in the store 65 the integrators 60 and 61 are again emptied by the impulse forming device 66 and the signal F from the subtractor 64 is again nil.

When a voltage arises at the output G of the store 65, the time switch 69 or 70 is started by the signals K or L of the impulse forming devices 67 or 68 dependent on the polarity of this voltage, said time switch 69 or 70 commands free via amplifiers 71, 72, 73 or 74 during a period of time $t_2$ or $t_3$ with signals M or N: the control members 41 of control valve 39, the control members 42 of control valve 40 or one of the control members 44 and 45 of a winch blocking device 47 and 48 respectively for avoiding hauling and veering respectively of the lifting cable 8 by the winch drum 13 during pushing the piston 25 back into the prescribed stroke T. These periods of time $t_2$ and $t_3$ are not only dependent on a determined adjusted value but are also influenced proportionally by the magnitude $G_K$ of the output voltage G of the store 65.

After expiration of the period of time $t_2$ and $t_3$ the store 65 is again emptied with signal O of the impulse forming device 75 after which this store 65 is ready for picking up a difference value F which is possibly formed again. The calculating device provides also for the possibility when exceeding an extremely high limiting value +Z and/or −Z adjusted with the limiting value switches 76 and 77 respectively during a period of time $t_4$ or $t_5$ predetermined by the time switches 78 and 79 respectively for controlling the winch drum 13 by means of control members 84 and 85 respectively with signals P and Q respectively amplified by amplifiers 80 and 81 respectively in order to limit the maximum working stroke of the piston 25 to the indicated value W limited by the values +Z and −Z.

The port switches 82 and 83 take care of actuating the winch control members 85 and 84 for "hauling" and "veering" respectively.

As noted above, when the working stroke T of the piston 25 within the cylinder 17 tends to be shifted more to one end or the other of the maximum working stroke W (see FIG. 3A), the piston is forced backward in its working stroke. In other words, having reference to FIG. 3A, if the working stroke T of the piston were shifted upwardly in FIG. 3A such that the tip of the upper arrow is above +U whereas the tip of the lower arrow is above −U, one of the control valves 31 or 40 would be actuated to force the piston movement backward in its working stroke T such that the working stroke T would approach the condition actually shown in FIG. 3A.

Figure 2:
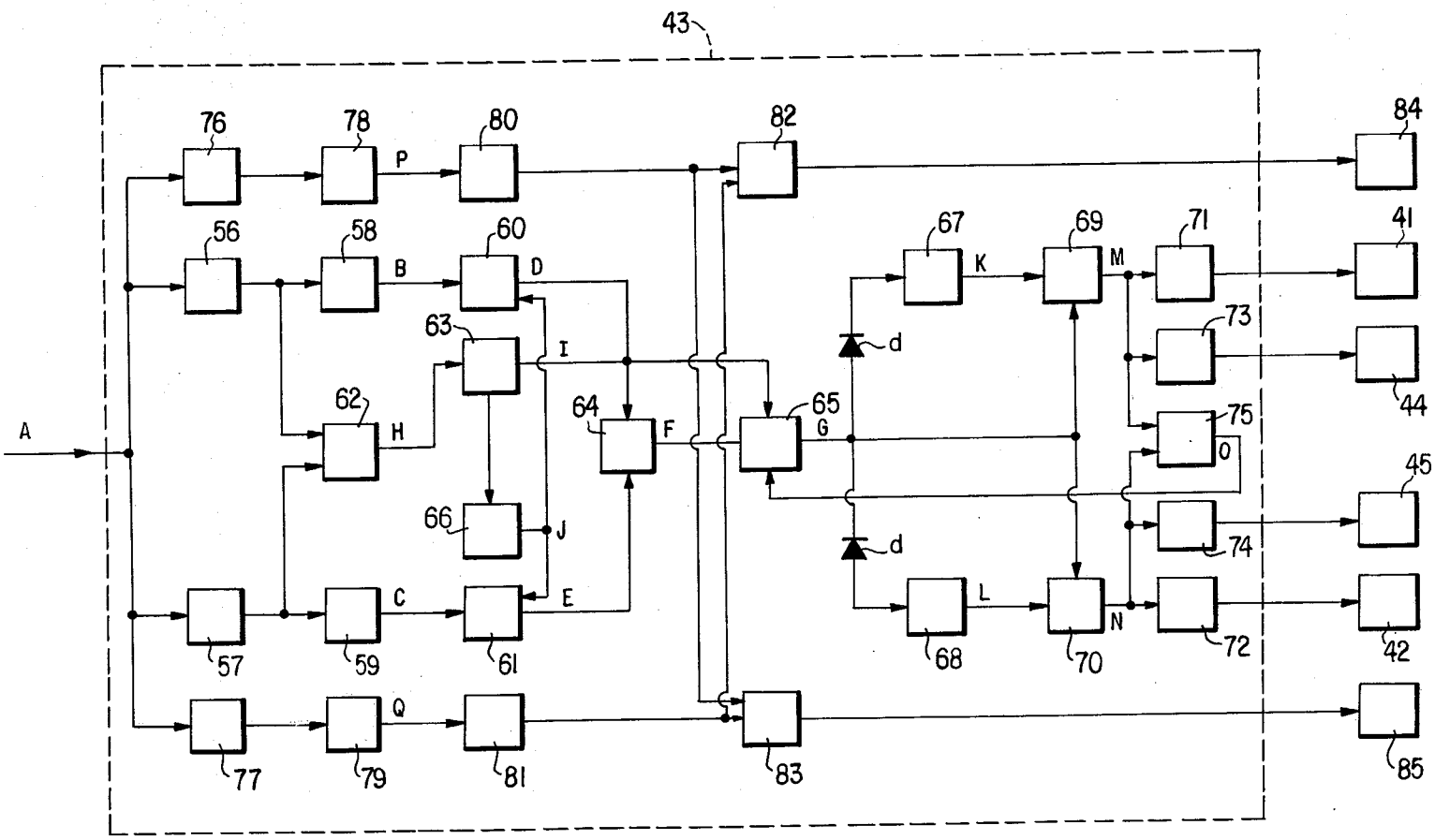
FIG. 2 is a schematic circuit diagram of the control system of this invention.
Figure 3A:
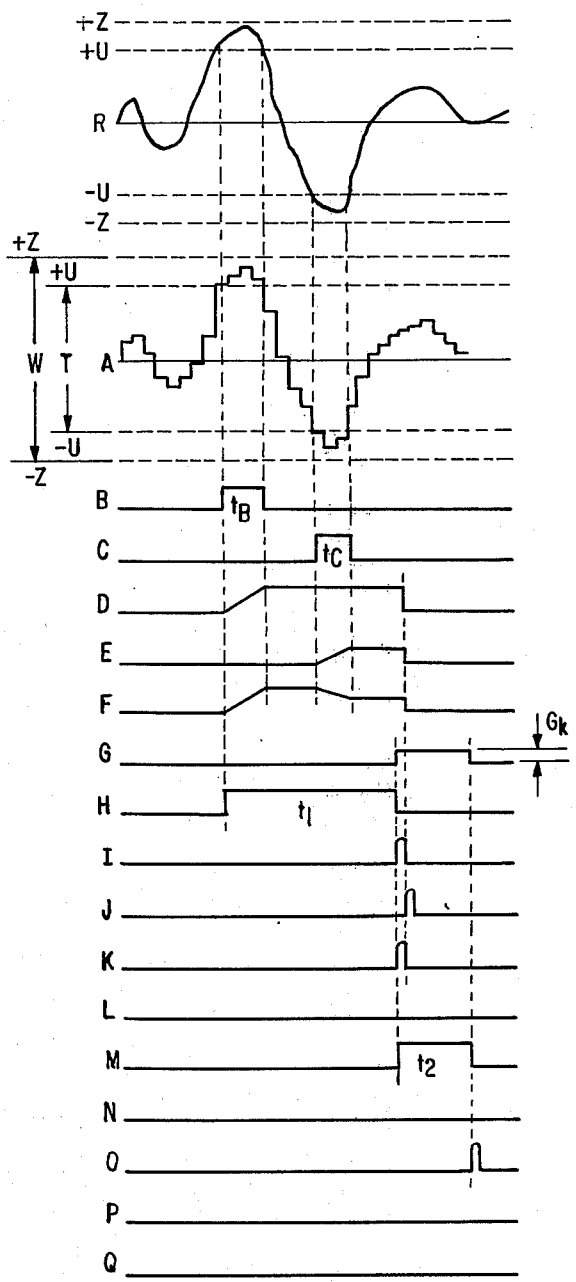
FIG. 3A is a waveform diagram illustrating signals generated by the circuit of FIG. 2 under certain conditions of wave action.

In FIG. 3A, the motion R of the member 30 (FIG. 1) relative to the fixed transducers 27, 28, which arrangement forms the sensing means 26, is illustrated wherein the time duration in which such motion R exceeds the value +U is greater than the time duration in which such motion R exceeds the value −U. The motion R is of course the relative motion between the member 30 and the fixed transducers 27, 28 and in FIG. 3A, positive values of R represent a condition in which the situation of FIG. 1 prevails, that is, wherein the upper end of the member 30 is in the region of the transducers 27, 28, the piston 25 being lowered in the cylinder 17. As noted hereinbefore, a midpoint mark on the scale 30 is picked up by the transducer 28 to reset or zero the counter device 29, which counter device has the output A as depicted in FIG. 3A and also which is shown as an input to the circuitry of FIG. 2. The counter device 29 is described in detail hereinafter and provides the voltage waveform A as is shown in FIG. 3A, which waveform is representative of the motion R of the scale 30 relative to the transducers 27, 28. The zero point for the signal A is of course determined by the transducer 28 and, as aforesaid, is set to occur at about the midpoint of the scale 30 which, as will be obvious, represents approximately the midpoint of the travel of the piston 25 in the cylinder 17.

As will be evident from FIG. 3A and also from the above discussion with respect to FIG. 2, the limit points +U and −U are not absolute limit points by which the backward repositioning of the working stroke T is effected, but the operation is, rather, dependent upon the time duration in which the piston excursions as represented by the curve R exceed the values +U and −U. Thus, in FIG. 3A, the time duration during which the piston motion causes R to exceed +U is greater than the time duration during which the motion R exceeds the negative limit −U and the net result of this is to provide an output signal $G_K$ whose magnitude controls the time duration $t_2$ during which the valve 39 is controlled by the device 41 to bleed additional liquid beneath the piston 25 and thus back it up in its next working stroke. Specifically, this action takes place as follows:

When the voltage waveform A exceeds the positive value +U in FIG. 3A, the switch 56 in FIG. 2 will be closed to apply a signal both to the pulse generating circuit 58 and to the timing circuit 62. The pulse generating circuit 58 is simply a step function generator which produces a positive step function output as shown in FIG. 3 at B so long as the input signal is present thereto from the voltage responsive switch 56. In FIG. 3A, the duration of this constant amplitude pulse shown at B is for the time duration $t_B$ which represents the time duration during which the motion R exceeds the positive value +U. The output pulse from the generator 58 is integrated by the integrator 60 to produce the output D as illustrated. Obviously, the circuit 60, as is the case with the circuit 61, is an integrate and hold circuit, as will be evident from the waveform indicated at D or at E in FIG. 3A. The values held by these two integrators 60 and 61 are dumped when the signal J occurs. The signal J is generated by the pulse generator 62, the pulse generator 63 and the pulse generator 66. The pulse generator 62 produces a fixed time constant output pulse of duration $t_1$ as is illustrated at H in FIG. 3A and, obviously, may take the form for example of a monostable multivibrator whose time constant is adjusted to the value $t_1$. The pulse generator 63 produces a short output pulse upon the occurrence of the trailing edge of the timing pulse $t_1$ at the conductor H, thereby to produce an output signal at the conductor I which causes the store 65 to produce an output signal on the conductor G. At the same time, the signal pulse from the generator 63 is applied to the pulse generator 66 which responds to the trailing edge of the pulse from the generator 63 to produce the delayed short duration pulse at the conductor J which dumps the two integrators 60 and 61. The duration of the pulse $t_1$ is sufficiently large as to accommodate for both the positive excursion of the motion R exceeding the limit +U and the negative excursion of the movement R which exceeds the negative limit −U. Thus, the switch 57 which is the negative value counterpart of the switch 56 is applied to the pulse generator 62 and to the constant amplitude pulse generator 59. Thus, the connection from the switch 57 to the pulse generator 62 assures that the time duration $t_1$ is sufficiently great as to encompass both the positive and negative excursions of R. The constant amplitude pulse from the generator 59 is represented as C and, again, is of a time duration determined by the duration in which the motion R exceeds the negative value −U, being shown in FIG. 3A as $t_C$. The integrate and hold circuit 61 produces the output signal at the conductor E and the two signals D and E are applied to the subtractor circuit 64 which produces the output signal of the waveform shown at F in FIG. 3A and this is applied to the store 65. As aforesaid, when the trailing edge of the timed pulse $t_1$ occurs, the generator 63 produces the output signal at I to cause the store 65 to output the instantaneous value of the difference signal F, the value of which is $G_K$ as illustrated in FIG. 3A. Because $t_B$ is greater than $t_C$, the polarity of the signal at G having a value $G_K$ will be positive and this signal is applied to the two pulse generators 67 and 68 which, as shown, have oppositely poled diodes d so that only the pulse generator 67 responds to this positive output signal $G_K$. The pulse generator 67 produces a short duration output enabling pulse as indicated at K which triggers the pulse generator circuit 69. The time duration $t_2$ of this circuit 69 is determined by the amplitude of the signal $G_K$ and the pulse signal $t_2$ is applied to the amplifier 71 to the valve control member 41 which operates to open the valve 39 for a time dictated by the duration of the pulse $t_2$ thereby to bleed high pressure liquid into the space beneath the piston 45 tending to raise such piston which, as aforesaid, has the effect of tending to retract or back-up the next working stroke of the piston relatively within the cylinder 17. The output signal at the conductor M is also applied to an amplifier 73 which is in control of the winch blocking mechanism 47 and, the signal is also applied to the pulse generator 75 which, in response to the trailing edge of the pulse $t_2$ produces a short duration output pulse at the conductor O which is applied back to the store 65 to dump it thereby terminating the store output signal at the conductor G.

Figure 3B:
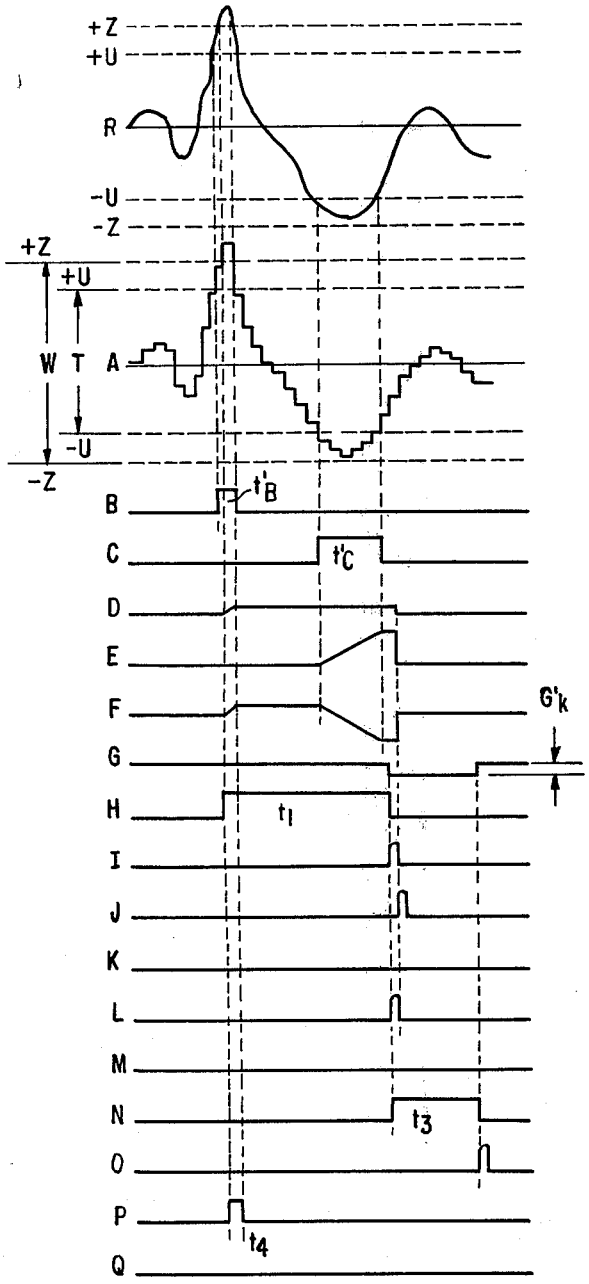
FIG. 3B is a waveform diagram similar to FIG. 3A but illustrating circuit response under other conditions of wave action.

If, as is depicted in FIG. 3B, the motion R is such as to exceed the positive value +Z, the voltage responsive switch 76 produces an output signal which triggers the pulse generator 78 to produce the pulse $t_4$ at the conductor P. The device 78, therefore, can for example take the form of a monostable multivibrator having a time constant $t_4$. The signal at P is amplified by the amplifier 80 and applied to the voltage responsive switch 82 which causes the winch veering control mechanism 84 to operate. The effect of this is to veer out some cable and allow the piston 25 to rise within the cylinder 17 which of course is a retrograde action of the piston so as to back-up its stroke as aforesaid. It should be noted that the operation of the control 84 or conversely of the control 85 is substantially instantaneous and occurs before the termination of the timing signal $t_1$ and consequent control of a valve 39 or 40. The two voltage responsive switches 82 and 83 are so interconnected that when one of them has a signal input thereto, this signal is applied to disable the other and vice versa. This prevents an accidental spurious signal from simultaneously operating both of the winch controls 84 and 85, the former of which causes cable to be paid out by the winch and the latter of which causes the winch to take in cable.

Figure 5:
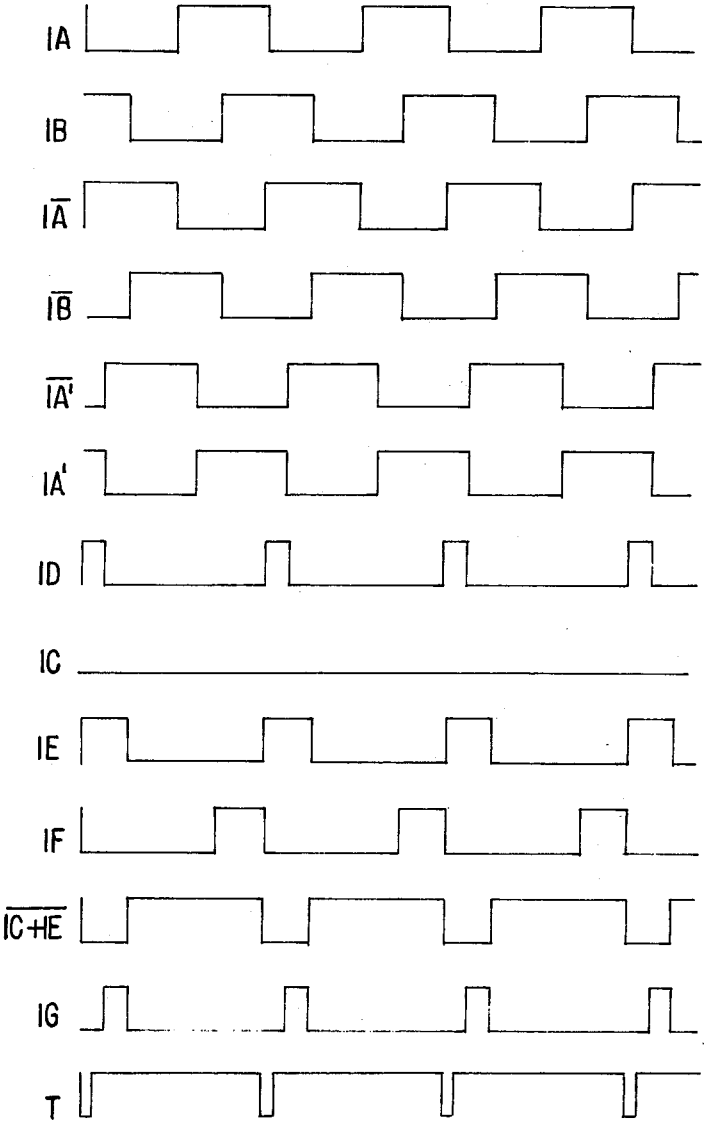
FIG. 5 is a waveform diagram similar to FIG. 4 but illustrating the signals generated during downward motion of the suction dredger.
Figure 4:
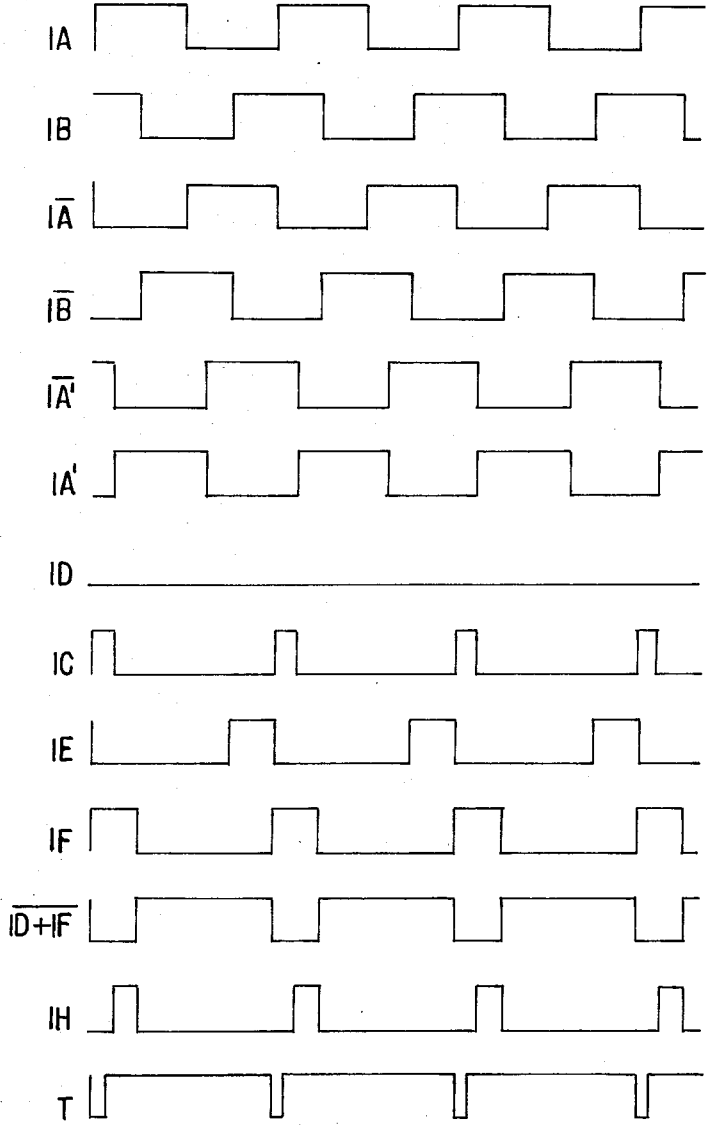
FIG. 4 is a waveform diagram illustrating signal generation of the circuits of FIGS. 6 and 7 during upward motion of the suction dredges.
Figure 8:
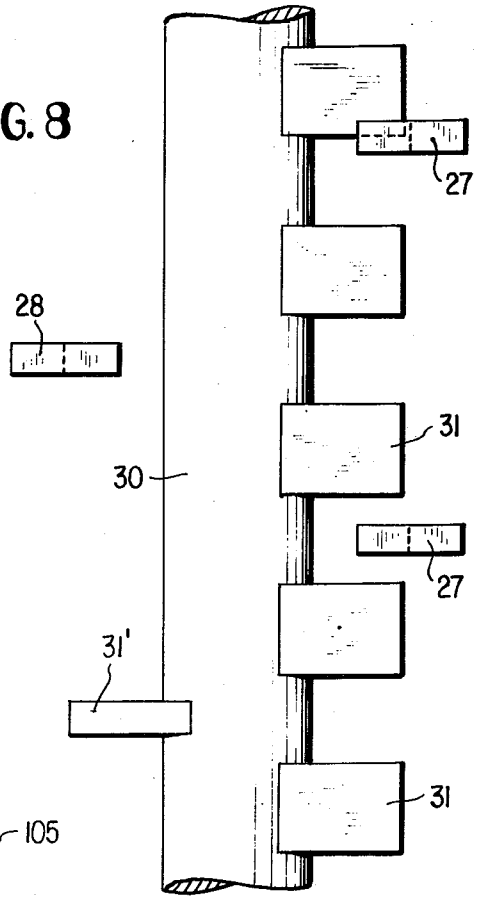
FIG. 8 is a view illustrating the motion detecting apparatus.
Figure 6:
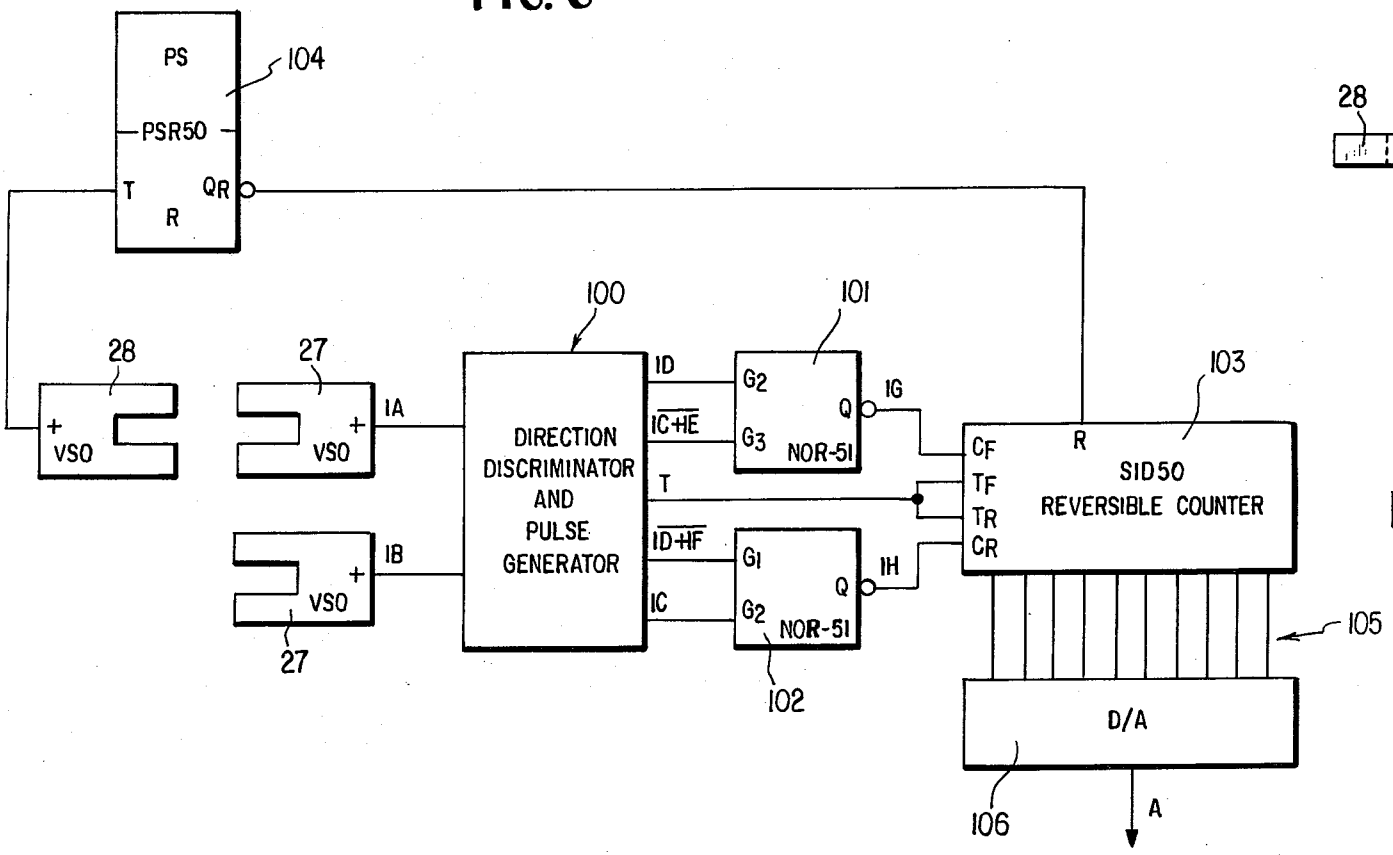
FIG. 6 is a schematic circuit diagram of the motion sensing circuit.

The motion sensing circuitry is, as previously mentioned, disclosed in the March, 1969 Philps Handbook relating to the 50 series components, Part II. The exemplary circuit is shown in FIG. 6 and the sensors 27, 28 and their detailed relation to the device 30 are shown in FIG. 8. The sensors or transducers 27, 28 are conventional inductive pick-up devices having bifurcations between which the metallic members 31, 31' pass. The members 31 are disposed on one side of the movable member 30, regularly spaced thereon as shown in FIG. 8, and the two fixed sensors 27 are positioned as shown relative thereto. Specifically, the two sensors 27 are so spaced relative to the periodicity of the members 31 such that the signals 1A and 1B are of the phase relationship shown in FIGS. 4 and 5, dependent upon the direction of movement of the device 30 relative to the sensors 27. For example, if the device 30 is moving downwardly in FIG. 8 (vessel rising), the upper sensor 27 will just be beginning inductively to respond to the entry of a member 31 between its bifurcations to produce the trailing edge of signal 1A as shown in FIG. 3B. If, on the other hand, the device 30 moves upwardly from the FIG. 8 position (vessel falling), the upper sensor 27 will just be beginning its inductive response to the movement of the member 31 from between its bifurcations to produce the leading edge of signal 1A as shown in FIG. 3A. Since in either case the lower sensor 27 is between two members 31, its signal 1B will not produce a trailing edge until the device 30 moves (either up or down) a distance equal to one-half the spacing between adjacent members 31. The width of each member 31 is equal to the spacing between adjacent members 31 so that the signals 1A and 1B are as shown in FIGS. 4 and 5. It will be appreciated that the waveform of FIGS. 4 and 5 are not time-based but are based on the movement of the device 30 relative to the sensors 27. Thus, dependent upon the direction of movement of the device 30, the phase relationship between the signals 1A and 1B is reversed, as shown in FIGS. 4 and 5.

The basic circuitry for generating the signals of FIGS. 4 and 5 is shown in FIG. 6. As shown, the two sensors 27 provide input to the direction discrimination and pulse generator circuit 100 which has the signals 1D, $\overline{1C+1E}$, T, $\overline{1D+1F}$ and 1C as outputs therefrom. The NOR circuits 101 and 102 are respectively provided with the inputs 1D, $\overline{1C+1E}$ and $\overline{1D+1F}$, 1C. The up/down or reversible counter 103 has "count forward" and "count reverse" inputs which are the signals 1G and 1H respectively and when one or the other of these signals is present, and simultaneously the clocking signal T is present, the counter responds by counting in the appropriate direction. To assure that the counter 103 is "zeroed" when the device 30 reaches the mid-point of its travel, the member 31' is disposed midway between the ends of the device 30 so that when the member 31' is aligned with the pick-up or sensor 28, the counter 103 is reset to zero. For this purpose, the inductive sensor 28 is connected to the buffer circuit 104 whose output is connected to the reset input R of the counter 103.

The counter 103 is provided with a plurality of count output lines 105 connected to the digital-to-analog converter 106 which produces the aforesaid signal A (FIGS. 3A and 3B).

Figure 7:
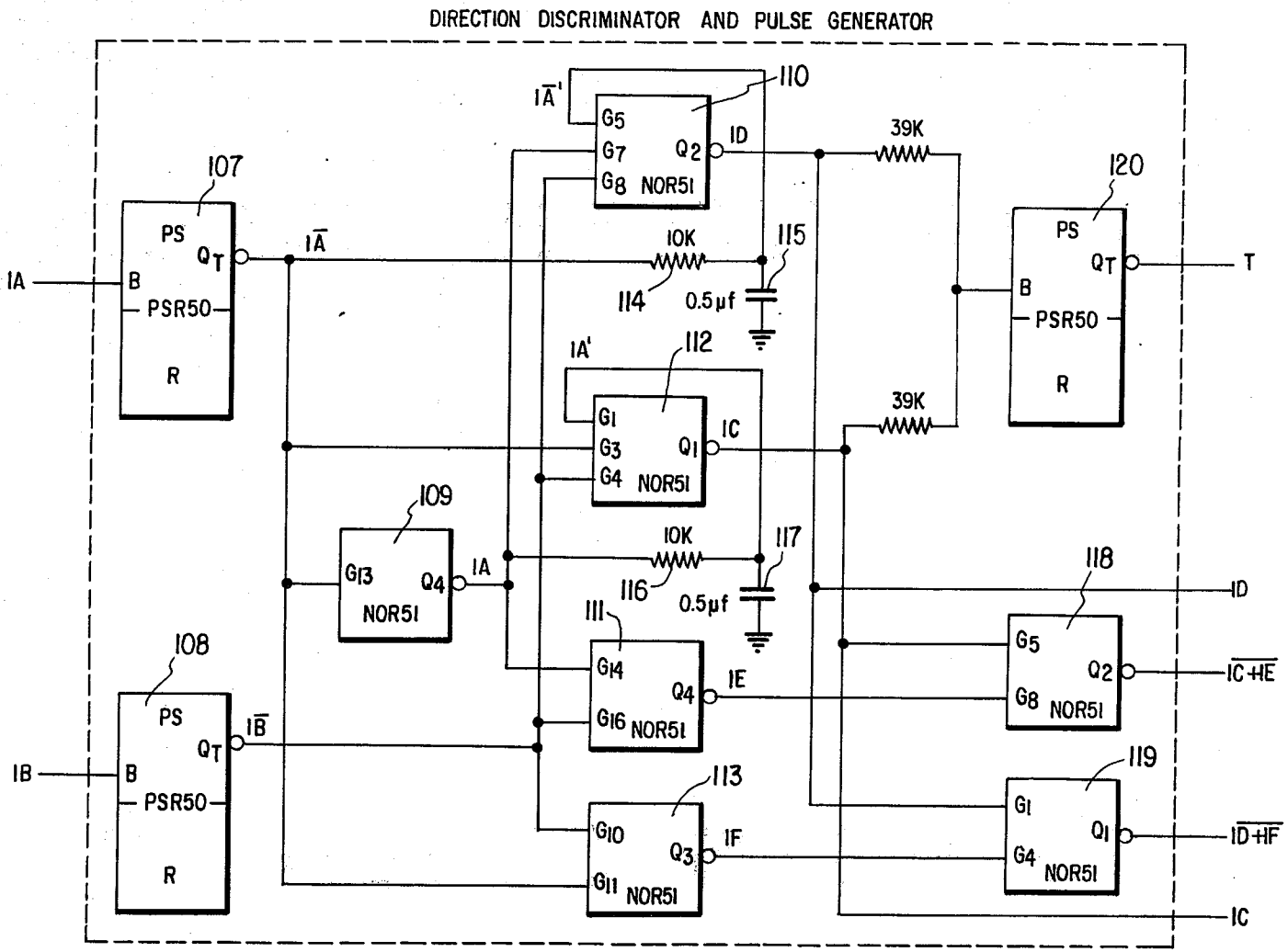
FIG. 7 is an expanded schematic circuit diagram of a portion of FIG. 6.

Details of the circuit 100 are shown in FIG. 7. The two signals 1A and 1B are applied to the inverting buffer circuits 107 and 108 respectively which provide the respective signals $\overline{1A}$ and $\overline{1B}$. The NOR circuit 109 is connected to invert the signal $\overline{1A}$ and its output, which sensibly is the signal 1A, is applied to the two NOR circuits 110 and 111. Another input to each of these NOR circuits is the signal $\overline{1B}$ from the inverter 108 and this signal is also applied as one input to each of the NOR circuits 112 and 113. Each of the NOR circuits 110 and 112 is provided with a third input which respectively is the signal $\overline{1A'}$ and the signal 1A'. The signal $\overline{1A'}$ is generated from the output of the circuit 107 time-delayed by means of the RC network comprising the resistor 114 and capacitor 115. Similarly, the signal 1A' is generated from the output of the inverter 109 time-delayed by means of the resistor 116 and capacitor 117. The NOR circuit 118 receives the outputs of the two NOR circuits 112 and 111 and the NOR circuit 119 receives the outputs of the two NOR circuits 110 and 113. The outputs of the two NOR circuits 110 and 112 are applied to the inverter 120 which produces the clocking input T to the counter 103.

It will be appreciated that by virtue of the phase inversion of the signal 1A in response to the direction of motion of the device 30, as illustrated in FIGS. 4 and 5, the circuitry of FIG. 7 is motion direction-discriminatory. Thus, when the vessel is falling, there can be no output from the NOR circuit 110 (and thus no signal 1G) because the several inputs $\overline{1A'}$, 1A and $\overline{1B}$ never simultaneously are "zero." On the other hand, the signal 1C will be generated because the inputs 1A', $\overline{1A}$ and $\overline{1B}$ to the NOR circuit 112 simultaneously are "zero" during the delay occasioned by the RC network 116, 117. Thus, the "count down" command 1H is present to the counter 103. Similarly, as is seen from FIG. 5, when the vessel is rising there can be no signal 1H and only the "count up" command 1G is present to the counter 103.

What is claimed is:

1. A suction dredger comprising a vessel and a suspension conveying conduit provided with a pump and having a nozzle adapted to be inserted in the bottom below the vessel and suspended by means of at least one cable of a lifting device on the vessel, said lifting device including a winch drum provided with control means for hauling and veering cable in order to adjust the depth of the nozzle with respect to the vessel, cable length variator means connected with said cable between said lifting device and said nozzle and comprising at least one piston which is movable in a cylinder and which has a travel corresponding with the variations of the rise and fall of said vessel as a result of sea level movement, said variator means also including an accumulator connected with said cylinder and a quantity of liquid within said cylinder and accumulator and a quantity of compressible gas trapped within said accumulator whereby the disposition of the working stroke within said cylinder determines the variations in the tension on said cable, sensing means for picking up the travel of the piston, a conduit communicating with the cylinder for controllable supplying and discharging liquid to said accumulator and cylinder whereby selectively to increase and decrease said quantity of liquid, and control means for controlling the supply and discharge of the liquid in dependence on the travel picked up by the sensing means to shift the movements of said piston into a prescribed stroke only when said travel exceeds first maximum and/or minimum positions within said cylinder in which said first maximum and minimum positions are widely spaced on opposite sides of the central position of said piston within said cylinder, the control means including means for actuating the control means of the winch drum only when the travel of the piston exceeds second maximum and/or minimum positions which are beyond said first positions.

2. In a suction dredger comprising a buoyant hull having a suction dredging system mounted thereon; said suction dredging system including a nozzle adapted to be inserted into the bottom below the hull, and conduit means between said nozzle and the hull for allowing the hull to rise and fall with relation to the nozzle incidental to wave action; winch means on said hull for supporting said nozzle and including at least one cable connected to said nozzle; and wave action compensating means engaged with said cable for paying out and taking in cable between said winch means and said nozzle as said hull respectively rises and falls due to wave action; said compensating means including at least one piston/cylinder device, a fluid pressure accumulator chamber connected with said device and means connected to the piston of said device and engaged with said cable whereby the piston reciprocates through working strokes in opposition to fluid pressure in said accumulator chamber dependent upon the rise and fall of said hull, said piston having maximum limits of travel; the combination of:

sensing means operatively associated with said piston for detecting the relative position of its working strokes within said maximum limits of travel thereof;

control means actuated by said sensing means for altering the fluid pressure in said accumulator chamber to shift the working strokes of said piston within said maximum limits of travel only when at least one of the end points of a stroke exceed widely spaced first limits which are equally spaced on opposite sides of the central position of said piston in said cylinder but are less than said maximum limits whereby continuously to maintain at least a selected minimum tension on said cable throughout said working strokes; and further control means actuated by said sensing means for actuating said winch means automatically to pay out and take in cable only when the working strokes of said piston as shifted within said maximum limits of travel thereof approach second limits which are more widely spaced than said first limits and correspond respectively to undesirable maximum and minimum tensions in said cable.

3. In a suction dredger as defined in claim 2 wherein said control means first mentioned also includes mechanism for inhibiting actuation of said winch means when said fluid pressure is being altered.

4. In a suction dredger comprising a buoyant and hull having a suction dredging system mounted therein; said suction dredging system including a nozzle adapted to be inserted into the bottom below the hull, and conduit means between said nozzle and the hull for allowing the hull to rise and fall with relation to the nozzle incidental to wave action; winch means on said hull for supporting said nozzle and including at least one cable connected to said nozzle; and wave action compensating means engaged with said cable for paying out and taking in cable between said winch means and said nozzle as said hull respectively rises and falls due to wave action, said compensating means including at least one piston/cylinder device, a fluid pressure accumulator chamber connected with said device and means connected to the piston of said device and engaged with said cable whereby the piston reciprocates through working strokes in opposition to fluid pressure in said accumulator chamber dependent upon the rise and fall of said hull, said piston having maximum limits of travel; the combination of:

sensing means operatively associated with said piston for producing an output indicative of the instantaneous position of said piston relative to a reference point lying essentially midway between said maximum limits of travel;

detecting means receiving said output of the sensing means for producing a first output signal only when a working stroke of said piston exceeds at least one of a pair of limit points and is offset relative to said reference point toward said one limit point and for producing a second output signal only when a working stroke exceeds the other of said pair of limit points and is offset relative to said reference point toward said other limit point, said pair of limit points lying on opposite sides of said reference point; and control means for increasing the fluid pressure in said accumulator chamber only when the time duration of said first output signal exceeds the time duration of said second output signal and for decreasing the fluid pressure in said accumulator chamber only when the time duration of said second output signal exceeds the time duration of said first output signal whereby to shift the mid-point of the working stroke of said piston toward said reference point.

5. In a suction dredger as defined in claim 4 wherein said control means includes means for inhibiting operation of said winch means in response to said first and second output signals.

6. In a suction dredger as defined in claim 5 wherein said detecting means includes means for producing a third output signal only when a working stroke of the piston reaches one of a second pair of limit points and for producing a fourth output signal only when a working stroke of the piston reaches the other of said second pair of limit points, said second pair of limit points lying beyond said first pair thereof on opposite sides of said reference point; and said control means including means responsive to said third output signal for operating said winch means to take in cable and means responsive to said fourth output signal for operating said winch means to pay out cable.

7. In a suction dredger as defined in claim 4 wherein said detecting means includes means for producing a third output signal when a working stroke of the piston reaches one of a second pair of limit points and for producing a fourth output signal when a working stroke of the piston reaches the other of said second pair of limit points, said second pair of limit points lying beyond said first pair thereof on opposite sides of said reference point; and said control means including means responsive to said third output signal for operating said winch means to take in cable and means responsive to said fourth output signal for operating said winch means to pay out cable.

* * * * *